United States Patent [19]

Clifford

[11] Patent Number: 4,534,189

[45] Date of Patent: Aug. 13, 1985

[54] APPARATUS FOR APPLYING CHEMICALS TO TEXTILES

[76] Inventor: Albert F. Clifford, Rte. 4, Box 1015, LaFayette, Ga. 30728

[21] Appl. No.: 568,571

[22] Filed: Jan. 5, 1984

[51] Int. Cl.[3] ..... D06B 5/08

[52] U.S. Cl. ..... 68/5 D; 68/200; 118/410; 118/612; 239/399; 239/432; 239/468; 261/79 A

[58] Field of Search ..... 68/5 D, 205 R, 200; 118/410, 612; 261/79 A; 239/432, 399, 468

[56] References Cited

U.S. PATENT DOCUMENTS

| | | | |
|---|---|---|---|
| 1,073,830 | 9/1913 | Wiley | 239/399 |
| 3,100,084 | 8/1963 | Biber | 239/399 X |
| 3,771,728 | 11/1973 | Polnauer | 239/468 |
| 3,978,695 | 9/1976 | Hurzeler et al. | 68/200 |
| 4,141,231 | 2/1979 | Kudlich | 68/205 R |
| 4,297,860 | 11/1981 | Pacifici et al. | 68/200 |

FOREIGN PATENT DOCUMENTS

| | | | |
|---|---|---|---|
| 30154 | 10/1959 | Finland | 239/399 |
| 457430 | 7/1965 | Japan | 68/205 R |
| 11153 | 4/1912 | United Kingdom | 239/468 |
| 1063889 | 3/1967 | United Kingdom | 118/410 |

*Primary Examiner*—Philip R. Coe
*Assistant Examiner*—Frankie L. Stinson
*Attorney, Agent, or Firm*—James B. Middleton

[57] ABSTRACT

A method and apparatus for chemically treating textile goods. An applicator has a slot for discharge of the chemical. The slot communicates with a mixing chamber in which the treating chemical and a gas are swirled under the influence of the gas, admitted under pressure. The swirling creates a homogeneous mixture which is discharged at high velocity to pass into the textile goods. A surfactant may be added to the chemical so the homogeneous mixture will foam after the mixture is in the textile goods.

4 Claims, 6 Drawing Figures

APPARATUS FOR APPLYING CHEMICALS TO TEXTILES

INFORMATION DISCLOSURE STATEMENT

Numerous chemicals are conventionally applied to textile goods, and various systems have been utilized for such application. By way of example, fabric dyes are applied, resist chemicals are applied preparatory to dyeing, and other chemicals such as soil repellents, sizing, fabric softeners and the like are applied to various textile goods. Regardless of the chemical to be applied, one of the criteria to be considered is uniform control over the application of the chemical. In the case of chemicals such as soil repellents, sizing and the like it will be understood that the chemical is to be applied uniformly throughout the goods. In the case of dye or resist chemicals, the chemical may be applied other than uniformly; but, it is necessary to control the application quite accurately to achieve the desired effect.

To achieve the desired uniformity, the chemical to be applied is conventionally diluted so controllable quantities of material can be applied to the textile goods. When the chemical is diluted with water, it will be understood that excess moisture must later be removed, resulting in large energy expenditures. When the chemical is diluted with air, through the use of a foamed chemical mixture, both uniformity of dispersion and full penetration are difficult to obtain.

The spraying of chemicals on textile goods has been used in various forms for a number of years. Such spraying normally takes the form of rather conventional spraying of a liquid using a stream of air. This arrangement is difficult to control accurately, and tends to place a large amount of the liquid in suspension in the ambient air. Airless sprayers have also been utilized, but these have been difficult to utilize for uniform application of a chemical throughout textile goods, and are expensive to use for printing patterns and the like. Furthermore, the airless sprayers are very difficult to control for complete penetration in pile fabrics such as carpeting, especially without total saturation of the fabric.

SUMMARY OF THE INVENTION

This invention relates generally to a method and apparatus for applying chemicals to textile goods, and is more particularly concerned with a system wherein a controlled quantity of a chemical is intimately mixed with a gas, and the resulting homogeneous mixture is expelled from a nozzle and applied to textile goods.

The present invention provides a nozzle having a mixing chamber, the mixing chamber receiving metered quantities of a treating chemical along with a gas under pressure. The chemical and the gas are swirled within the mixing chamber, and expelled therefrom under the gas pressure. The mixture expelled from the nozzle is directed against textile goods for treating the textile goods. In treating pile fabric such as tufted carpet, the chemical mixed with gas may be directed against the back of the carpet, and the velocity of the gaseous mixture forces the chemical into the face yarns. A chemical foaming agent may also be used to cause the chemical to be foamed after the chemical has been placed into the textile goods. In one preferred embodiment of a treating system, the textile goods will be washed, excess moisture and lint being removed by a vacuum means, and a chemical applied using the apparatus of the present invention. The textile goods are then passed around a heated drum for drying.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
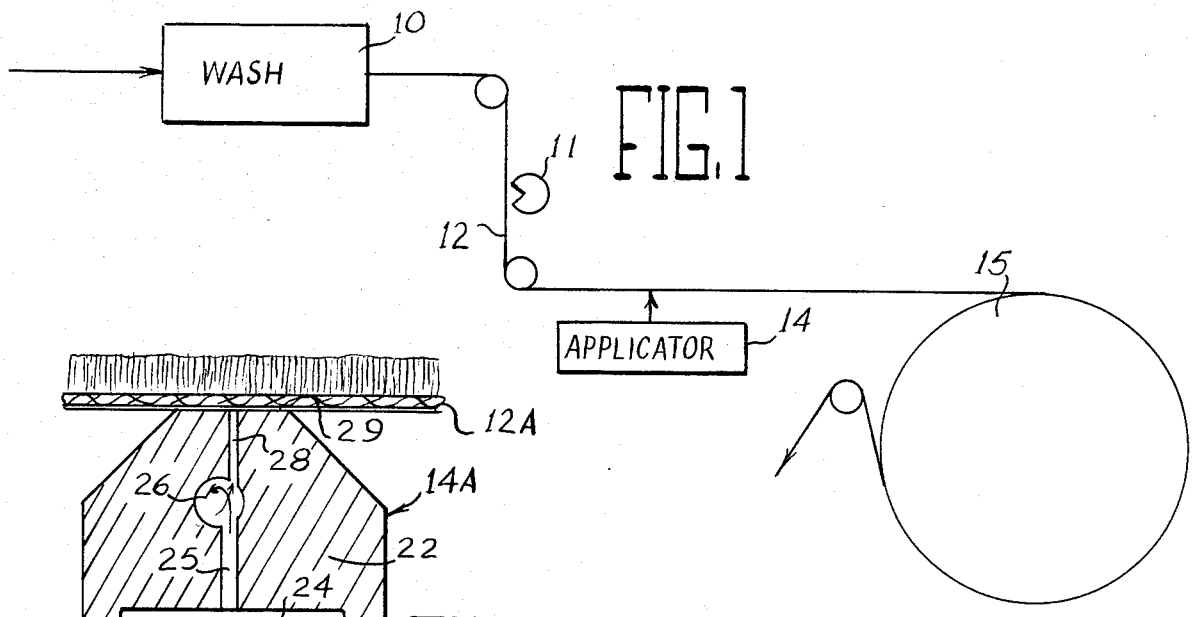
FIG. 1 is a schematic diagram showing a textile treating system utilizing the present invention.

Referring now more particularly to the drawings, and to those embodiments of the invention here presented by way of illustration, FIG. 1 shows schematically a textile treating system made in accordance with the present invention. It will be seen that there is a washing or scrubbing means indicated at 10. It has been found that, especially for tufted carpeting and the like, it is necessary to remove oils and other chemicals from the carpeting before the carpeting is dyed. Thus, the carpeting or other textile goods may first pass through a washing means 10, then pass by a vacuum slot 11. The vacuum slot 11 is well known to those skilled in the art, and would be placed adjacent to the textile material 12 so the vacuum slot 11 will remove a significant amount of moisture, and will also remove loose fibers and other debris from the material.

After passing by the vacuum slot 11, the textile goods 12 pass by an applicator designated at 14, the applicator 14 being made in accordance with the present invention as will be discussed in more detail hereinafter. The applicator 14 will apply dye, soil repellent, sizing or virtually any other chemical treatment for textile goods. After application of the chemical by the applicator 14, the textile goods 12 pass around the surface of a heated drum 15 for drying the goods. After the textile material 12 has been dried by the drum 15, the material will be passed to wind-up means for storage or further treatment.

Figure 2:
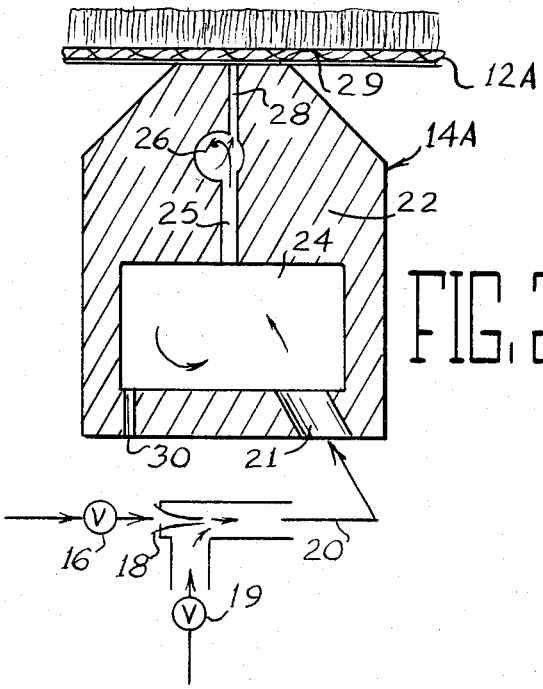
FIG. 2 is a cross-sectional view through one form of applicator made in accordance with the present invention, with a schematic showing of the feed to the applicator.

Attention is now directed to FIG. 2 of the drawings which illustrates one form of applicator 14. The applicator is generally designated at 14A, and the textile material to be treated is shown as tufted carpeting designated at 12A. It is important to note that the carpeting 12A is oriented so the backing of the carpet 12A is against the applicator 14A.

There is a schematic showing wherein steam is controlled by a valve 16, and passes into a venturi 18. By way of example, liquid dye material may be fed through the valve 19 and into the side of the venturi 18 so the dye material will be mixed with the steam. The mixture will then pass through the line indicated at 20 and into the port 21 of the applicator 14A.

The applicator 14A includes a generally solid body designated at 22, and having a cavity 24 for receipt of the steam and dye mixture. It will be understood that the body 22 will be long enough to extend the full width of the textile material 12A to be treated, and the cavity 24 is large enough to allow the gas and chemical mixture to be distributed uniformly throughout the width of the applicator 14A.

From the cavity 24, there is a passage 25 connected to a mixing chamber 26. While the passage 25 is here shown as a single passage, it will be understood that there will be a plurality of passages 25 extending throughout the length of the applicator 14A, the passages 25 being substantially uniformly spaced to allow uniform feed into the mixing chamber 26 throughout the width of the applicator 14A.

It will be seen that the passage 25 is arranged on a chord of the mixing chamber 26 so that, as the fluid under pressure passes from the passage 25 into the mixing chamber 26, the fluid will be swirled around the circular mixing chamber 26. This swirling will effect thorough mixing of the steam or other gas with the dye or other treatment chemical.

There is a slot 28 extending from the mixing chamber 26 to the face 29. It should be understood that the slot 28 will be a continuous slot, running throughout the length of the applicator 14A, providing a nozzle arrangement for discharging the mixture.

Those skilled in the art will understand that steam or other gas will be fed into the cavity 24 under pressure. Considering the laws of fluids, it will further be understood that the pressure on the fluid will remain constant throughout passage of the fluid through the applicator 14A. Since the pressure remains the same and the cross-sectional area of the passage is reduced, the velocity of the fluid will be increased considerably, so the fluid leaving the nozzle through the slot 28 will be at a very high velocity. The high velocity of the fluid will cause the fluid to pass well into the carpet or other textile material 12A; and, with the combination of the high velocity to enter the material 12A, and further wick action, the textile material 12A will be uniformly treated with the dye or other chemical material.

It will also be noted that there is a small aperture designated at 30 connected to the cavity 24. Since the applicator 14A is contemplated for use with steam, condensate must be considered. The opening 30 is to allow condensate to be removed after the use of the applicator 14A.

Figure 3:
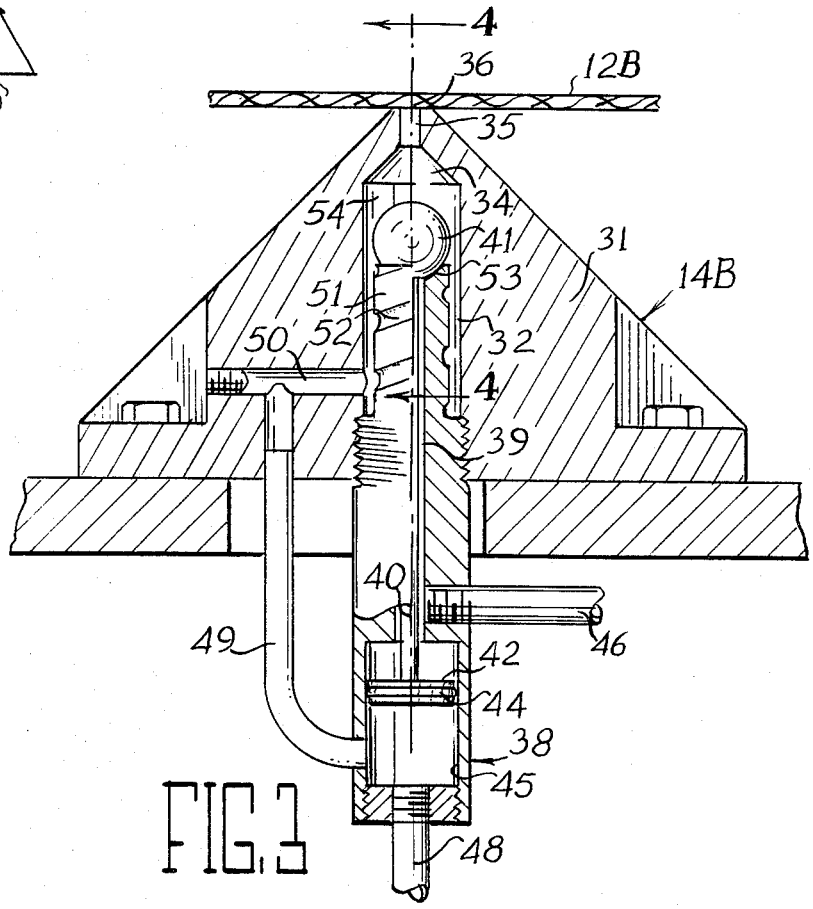
FIG. 3 is a cross-sectional view through a different form of applicator made in accordance with the present invention.

Looking next at FIG. 3 of the drawings, there is a modified applicator designated at 14B. The applicator 14B includes a body 31, the body having a central bore 32, the bore 32 having a reduced upper end 34 terminating in a slot 35. The slot 35 extends into communication with the face 36 of the applicator 14B. The slot 35 is better shown in FIG. 4 of the drawings.

Figure 4:
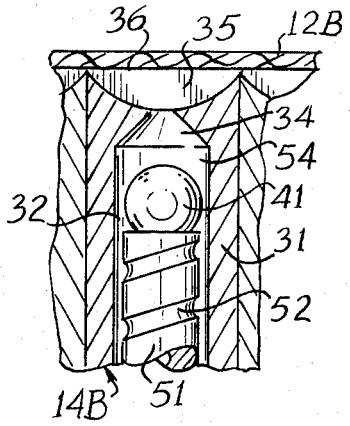
FIG. 4 is a fragmentary view taken substantially along the line 4—4 in FIG. 3.

In the embodiment of the applicator shown in FIGS. 3 and 4, there is a stem assembly generally designated at 38. The stem assembly 38 includes a central chemical passage 39 having a rod 40 slidable therein. The rod 40 is fixed to the valve member 41 which will be discussed more fully hereinafter, and the opposite end of the rod 40 is connected to a slidable piston 42 having an O-ring 44 for sealing the piston 42 with respect to the chamber 45.

There is a pipe 46 for admitting dye or other chemical into the passage 39. It will therefore be seen that the dye or other chemical can be admitted through the pipe 46 and into the channel 39. The chemical will be sealed in one direction by the piston 42 so the chemical is constrained to move up the channel 39 towards the valve member 41.

It will now be seen that the chamber 45 has a gas inlet 48. Steam or other gas entering the inlet 48 will be prevented from entering the channel 39 by the piston 42, so the gas will pass through the pipe 49 to be fed to the injection passage 50. From the passage 50, the gas will be released into the bore 32 where the gas will be directed against the fluid directing means 51. It will be seen that the fluid directing means 51 is a generally cylindrical member which is a portion of the stem assembly 38. The member 51 includes generally helical grooves 52 for causing the fluid to move in a cyclonic pattern.

From the foregoing, it should be understood that steam or other gas under pressure will be admitted through the line 48 and into the chamber 45. This pressure will tend to move the piston 42 upwardly to remove the valve member 41 from the valve seat 53, thereby allowing the dye or other chemical to pass from the line 46, through the channel 39 and into the mixing chamber designated at 54 which is a portion of the bore 32. From this construction it will be observed that, if the line 46 is under pressure while the line 48 and the chamber 45 are not under pressure, the piston 42 will move down, urging the valve member 41 against the valve seat 53.

Meanwhile, the steam passes through the line 49, through the passage 50 and is swirled around inside the bore 32 to provide a cyclonic mixing action in the mixing chamber 54. The mixed material will be under pressure and will be caused to pass through the nozzle slot 35 and into the textile goods 12B.

Again, since the applicator 14B may be used with steam, the condensate will be allowed to pass through the passage 50, down the line 49 and into the chamber 45.

Figure 5:
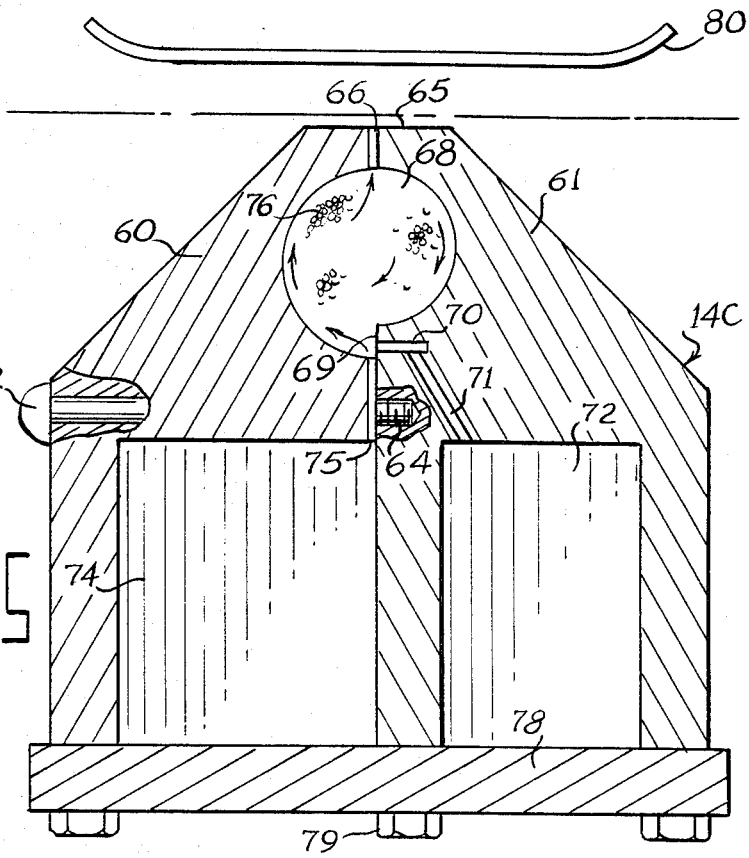
FIG. 5 is a cross-sectional view showing a modified form of the applicator shown in FIG. 2 of the drawings; and, FIG. 6 is a front elevational view, on a reduced scale, showing the applicator of FIG. 5.

Attention is next directed to FIG. 5 of the drawings which shows another embodiment of the applicator of the present invention, the applicator in FIG. 5 being designated at 14C. It will be noted that the applicator 14C is similar to the applicator 14A, but allows internal mixing of dye or other treating liquid along with steam or other gas as in the nozzle 14B.

Looking at the applicator 14C in more detail, it will be seen by those skilled in the art that the applicator 14C can be readily manufactured in two pieces designated at 60 and 61. The two pieces 60 and 61 are conveniently parted generally along the centerline, and are held together by means of a plurality of machine screws 62 passing through appropriate apertures in the part 60 and threaded into the part 61 as indicated at 64. By dividing the applicator 14C along the centerline, it will be seen that the device can be readily machined using conventional techniques.

The applicator 14C includes a nozzle face 65 having a nozzle slot 66. The slot 66 communicates with a mixing chamber 68 which extends throughout the length of the applicator 14C. The mixing chamber 68 is formed of two semi-cylindrical cuts having different radii. The portion of the mixing chamber in the part 61 has a smaller radius, and the portion of the mixing chamber 68 in the part 60 has a larger radius. The two portions of the mixing chamber 68 are aligned adjacent to the slot 66, and are misaligned diametrically therefrom. In the resulting step indicated at 69, there is an injection slot 70. The slot 70 will extend throughout the length of the part 61, and there will be a plurality of passages 71 extending from the slot 70 into the cavity 72. The cavity 72 will receive gas under pressure; therefore, the gas under pressure can pass from the cavity 72, down the passages 71 and into the injection slot 70. From the injection slot 70, fluid will be directed somewhat tangentially within the mixing chamber 68 and cause a swirling within the chamber 68.

It will be noted that there is a cavity 74 in the part 60, and a plurality of passages 75 extend from the cavity 74, extending generally diametrically of the mixing chamber 68, communicating at the step 69. It will therefore be understood that, with a gas being injected from the slot 70 to move generally tangentially of the mixing chamber 68, a liquid can be injected from the cavity 74 and through the passages 75 so the liquid will be caught in the injected gas stream and swirled around the mixing chamber 68 to effect thorough mixing.

It will also be noted that a plurality of small spheres is indicated at 76. It is contemplated that glass beads or the like will be placed into the mixing chamber 68 to assist in providing a homogeneous mixture within the mixing chamber 68.

To complete the applicator 14C, there is a cover plate designated at 78, the cover plate 78 being fixed to the applicator 14C by appropriate screws 79.

Figure 6:
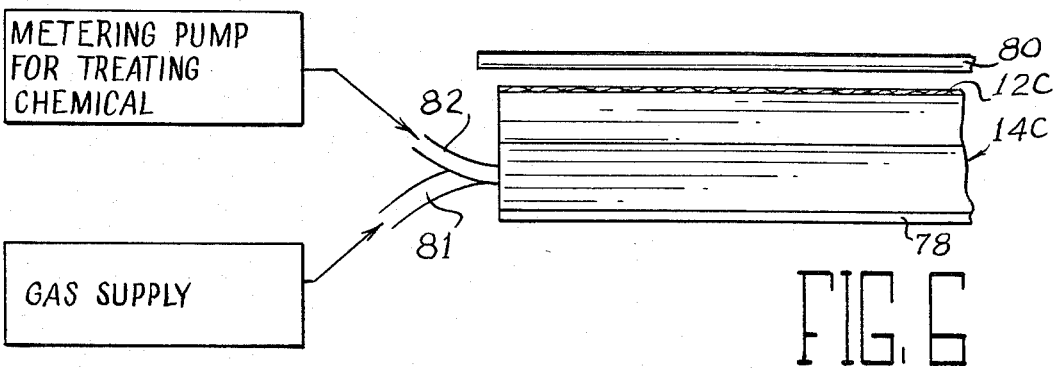

Looking now at FIG. 6 of the drawings, the applicator 14C is shown in elevation, and it will be seen that there is a fabric 12C passing over the nozzle surface 65. Also, there is a shield 80 above the applicator 14C. A first pipe 81 is shown to provide a supply of gas to the cavity 72, the gas being steam or other appropriate gas for the treatment desired. A second pipe 82 is shown for communicating with the cavity 74 and providing dye liquor or other treatment chemical. It is contemplated that the chemical will be metered into the cavity 74.

With the foregoing discussion in mind, it should be understood that, in using the applicator 14C one might add a surfactant as is well known in the art to cause foaming of the treatment liquid. For dyeing textiles, for example, the dye liquor with an appropriate amount of surfactant can be metered into the cavity 74, and an appropriate amount of steam supplied to the cavity 72. The dye liquor will pass through the passages 75 and into the mixing chamber 68 while steam passes through the passages 71 and out the injection slot 70. There will be a resulting swirling and mixing of the dye liquor and the steam while the spheres 76 assist in providing even distribution of the material. It will be understood that, even though a surfactant has been added to the dye liquor, there can be no foaming within the mixing chamber 68 because the chamber will be at high pressure.

Since the mixing chamber 68 will be at high pressure, it will be readily understood that a generally homogeneous mixture of steam and dye liquor will be forced through the slot 66. As before, the material will be forced through the slot 66 at a rather high velocity. In the event the material is directed against a heavy pile fabric such as carpeting, the carpeting will usually absorb all of the applied material; however, in the case of general textiles, the velocity of the treating material may be so high as to pass completely through the textile material. In this event, the shield 80 will be used to stop the stream on the other side of the material 12C.

Once the dye containing the surfactant engages the fabric 12C, the material will be generally at ambient pressure so foaming can take place. This results in further leveling action within the fabric 12C. It will be understood that the initial application from the slot 66 will be substantially uniform; then, wick action will tend to cause further migration of liquid within the textile goods; and, by causing the liquid to foam, the bubbles of the foam will tend to migrate to otherwise untreated portions of the fabric. Considering all these actions, the treatment using the nozzle 14C will be quite uniform.

It will therefore be understood that the present invention provides a relatively simple method wherein the treating liquid is fed into a gas stream, the liquid and gas are swirled for thorough mixing, and the resulting mixture is expelled through a nozzle opening onto textile goods. The applicators 14A and 14C provide a continuous nozzle slot for uniform treatment throughout the width of a piece of textile goods, while the applicator 14B is well adapted for relatively narrow widths and can be easily adapted to different treatments, such as different colors, along the width of a single piece of textile goods. Also, due to the construction of the applicators, it will be understood that virtually any gas including air, nitrogen, steam and the like can be used as the gas, and virtually any liquid can be fed into the gas stream. For use in dyeing carpeting, steam is highly desirable since the heat will assist in setting dye.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as defined in the appended claims.

I claim:

1. An applicator for applying a liquid chemical to textile goods, wherein said textile goods move across said applicator while said applicator discharges said liquid chemical, said applicator including a body, a nozzle face at one end of said body for receiving textile goods thereagainst, a mixing chamber defined within said body, a slot defined in said body for connecting said mixing chamber to said nozzle face, and means for supplying a metered quantity of said liquid chemical and a quantity of gas under pressure to said mixing chamber, said body further defining a first cavity and a second cavity therein, said second cavity constituting said means for supplying a metered quantity of said liquid chemical, said first cavity constituting said means for supplying a quantity of gas under pressure, first passage means for connecting said first cavity with said mixing chamber and second passage means for connecting said second cavity with said mixing chamber, said body including a first part and a second part, said mixing chamber being generally cylindrical and including a first portion of said mixing chamber defined in said first part and having a first radius, a second portion of said mixing chamber defined in said second part and having a second radius, said second radius being larger than said first radius for defining a step in said mixing chamber, said first cavity being in said first part and said second cavity being in said second part, said first passage means opening into said mixing chamber on said step so that said gas under pressure is directed generally tangentially of said mixing chamber.

2. An applicator as claimed in claim 1, said second passage means opening into said mixing chamber adjacent to said step for feeding said liquid chemical into the stream of gas from said first passage means.

3. An applicator as claimed in claim 2, and further including a plurality of spheres within said mixing chamber.

4. An applicator as claimed in claim 3, and further including a shield disposed in a plane parallel to the plane of said textile goods, said shield being located to receive the discharge from said applicator when such discharge passes through said textile goods.

* * * * *